US005360373A

United States Patent [19]

Makulla et al.

[11] Patent Number: 5,360,373

[45] Date of Patent: Nov. 1, 1994

[54] UPWELLING-AIR DISTRIBUTOR FOR AIR-CONDITIONING SYSTEMS

[75] Inventors: Detlef Makulla, Overath; Marten Brunk, Odenthal, both of Germany

[73] Assignee: H. Krantz-TKT GmbH, Gladbach, Germany

[21] Appl. No.: 154,845

[22] Filed: Nov. 19, 1993

[30] Foreign Application Priority Data

Jan. 8, 1993 [DE] Germany ..... 4300300

[51] Int. Cl.[5] ..... F24F 13/06

[52] U.S. Cl. ..... 454/284; 454/306

[58] Field of Search ..... 454/284, 297, 298, 306, 454/322, 333

[56] References Cited

U.S. PATENT DOCUMENTS 5,033,362 7/1991 Huckestein ..... 454/322

FOREIGN PATENT DOCUMENTS

| | | | |
|---|---|---|---|
| 3304151 | 8/1984 | Germany | 454/284 |
| 172858 | 7/1988 | Japan | 454/298 |
| 840608 | 6/1981 | U.S.S.R. | 454/284 |
| 156938 | 4/1990 | U.S.S.R. | 454/284 |
| 14905 | 10/1991 | WIPO | 454/284 |

*Primary Examiner*—Harold Joyce
*Attorney, Agent, or Firm*—Max Fogiel

[57] ABSTRACT

An upwelling-air distributor for air-conditioning systems. It comprises two concentric, air-permeable cylinders, an outer cylinder (1) and an inner cylinder (2). The cylinders accommodate one or more diaphragms (10 and 11) in the form of flat rings. The distributor is connected to the ventilating system by an air intake (3) at one end. A pipe (6) is accommodated inside the inner cylinder. The pipe is provided with a butterfly valve (7) and is open at the end remote from the air intake. Air can flow through the pipe except when the valve is closed.

8 Claims, 2 Drawing Sheets

UPWELLING-AIR DISTRIBUTOR FOR AIR-CONDITIONING SYSTEMS

BACKGROUND OF THE INVENTION

The present invention concerns an air distributor for air-conditioning systems.

Such distributors are called upwelling-air distributors or stratified-air distributors. They usually stand upright on the floor, so that the incoming air flowing out of them toward anyone occupying the air-conditioned space will not have too far to flow. The incoming air flows, especially in high-ceilinged and contaminated industrial spaces, through a relatively uncontaminated region just above the floor. The incoming air accordingly mixes relatively little with the contaminated ambient air before being breathed in by the occupants. Since the source of heat and the source of contamination are usually identical in industrial spaces, the liberated contaminants rise by convection to the ceiling, where they are intercepted by the exhaust system. To maintain this current, the upwelling-air distributors must decelerate the flow of incoming air into the space and accelerate the flow of rising air. This approach will prevent the contaminated air from recirculating back from the ceiling into the space where the occupants are staying or working.

To ensure that the incoming air emerging from an upwelling-air distributor will remain in the occupied space, the air must be denser and accordingly cooler than the rest of the air. The air's tendency to radiate can of course not be exploited for this purpose because it must as hereintofore pointed out be kept low in order to avoid obstructing the contaminated air rising in the vicinity of the machinery. Another result is that less ambient air will be forcibly mixed with the incoming air.

An upwelling-air distributor of the aforesaid genus is known from German OS 4 037 287. It comprises a perforated cylinder with horizontal and vertical components of perforated sheet metal. These components uniformly deflect the incoming air inside the cylinder and supply it horizontally to the space being air-conditioned. The higher density and lower temperature of the air leaving the distributor horizontally, however, provide it with a component that flows toward the floor. This situation is reinforced by the floor's Coanda effect. The stratum of incoming air becomes constricted and considerably accelerated, by a factor of as much as 2 to 3. The result is drafts and increased recirculation of the contaminated ambient air.

Another drawback of known upwelling-air distributors is that they cannot be utilized to heat the occupied space. Any hot air emitted, emerging as slowly as it does, would rise immediately to the ceiling and would not remain where needed. The incoming air can be warmer than the ambient air in summer of course because in most industrial spaces it is not mechanically cooled. Here again the warm incoming air will immediately rise to the roof and only some of it will get to the occupants and only after being recirculated along with the contamination.

SUMMARY OF THE INVENTION

The object of the present invention is a generic upwelling-air distributor that will not cause drafts and that can be utilized to heat up the space being air conditioned.

A butterfly valve on the pipe inside the distributor can be opened and closed as desired to regulate the flow of incoming air in accordance with whether it is cooler or warmer than the ambient air. When the incoming air is cooler, the valve opens and creates a current of air with specific characteristics. First, it flows at a speed that increases from the bottom to the top along the outer cylinder. Second, it flows up at an angle. It is also possible to superimpose a swirling motion over the whole current. These features eliminate acceleration of the air flowing through the occupied space due to descending cold air. When the incoming air is warmer than the ambient air, the valve closes. The incoming air now flows down out of the upwelling-air distributor at a rate that definitely increases from top to bottom. These features counteract the rise of the warm incoming air.

BRIEF DESCRIPTION OF THE DRAWINGS

One embodiment of the invention will now be specified with reference to the drawing, wherein.

DESCRIPTION OF THE PREFERRED EMBODIMENTS

Figure 2:
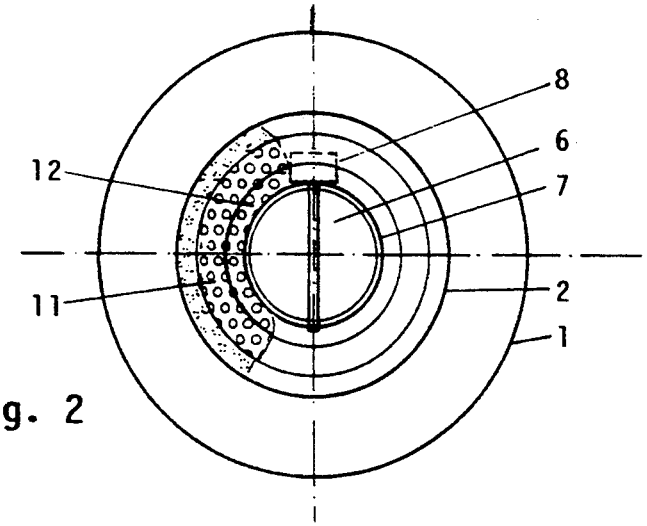
FIG. 2 is a top view of FIG. 1, and FIGS. 3 and 4 illustrate air flowing through the upwelling-air distributor illustrated in FIGS. 1 and 2.
Figure 1:
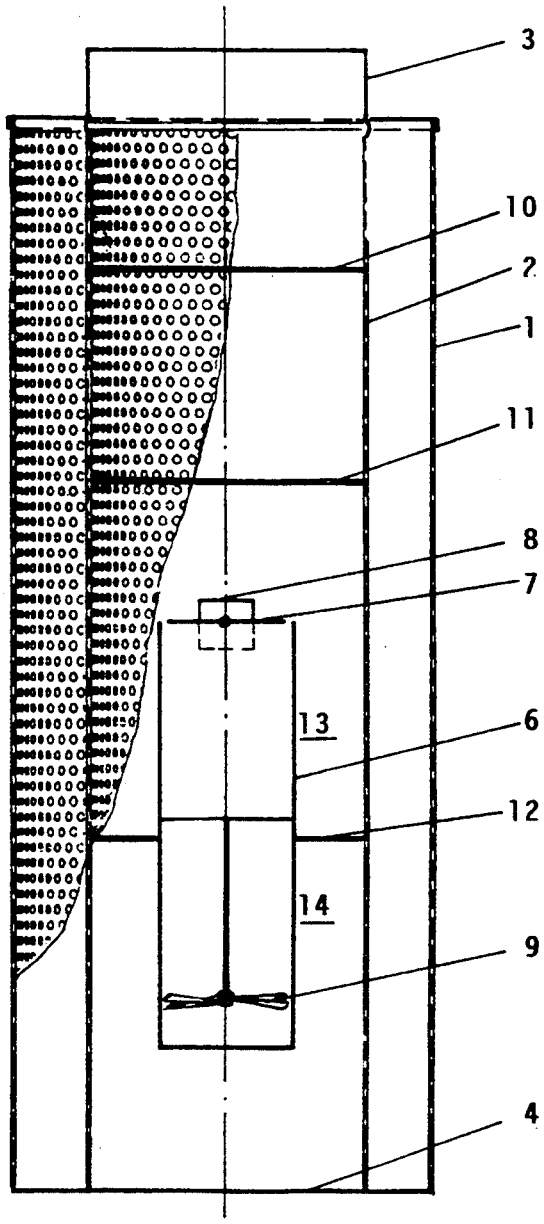
FIG. 1 is a longitudinal section through an upwelling-air distributor.

The illustrated upwelling-air distributor comprises two concentric air-permeable cylinders, specifically an outer cylinder 1 and an inner cylinder 2. Both cylinders are made of perforated sheet metal. There is an air intake 3 in the solid roof of the distributor. Air intake 3 obtains air from the buildings ventilating system. The base 4 of the distributor is also solid. The distributor rests on the floor 5 of the factory or other industrial space being treated.

Accommodated loosely inside inner cylinder 2 and in the lower half of the upwelling-air distributor is a pipe 6. Pipe 6 is open at each end. It can be blocked off by a butterfly valve 7 rotating on an axis inside it or on it. The flap can be rotated manually with a projecting handle or automatically by an electric or pneumatic mechanism 8.

The air at the bottom of pipe 6 can be induced to swirl by fan 9 accommodated therein. The swirling motion can be augmented and reduced by raising and lowering fan 9 inside the pipe or by increase and decrease the angle of its blades.

Horizontally accommodated inside inner cylinder 2 and above pipe 6 are one or more diaphragms 10 and 11 in the form of flat rings. The periphery of some of the diaphragms is solid, like that of the illustrated diaphragm 10. The periphery of others is perforated, like that of the illustrated perforated-periphery diaphragm 11.

Horizontally accommodated between pipe 6 and inner cylinder 2 is another diaphragm 12. Diaphragm 12 spans the gap between the pipe and cylinder and divides it into two compartments 13 and 14. The periphery of diaphragm 12 can be either solid or perforated or intersticed.

Figure 3:
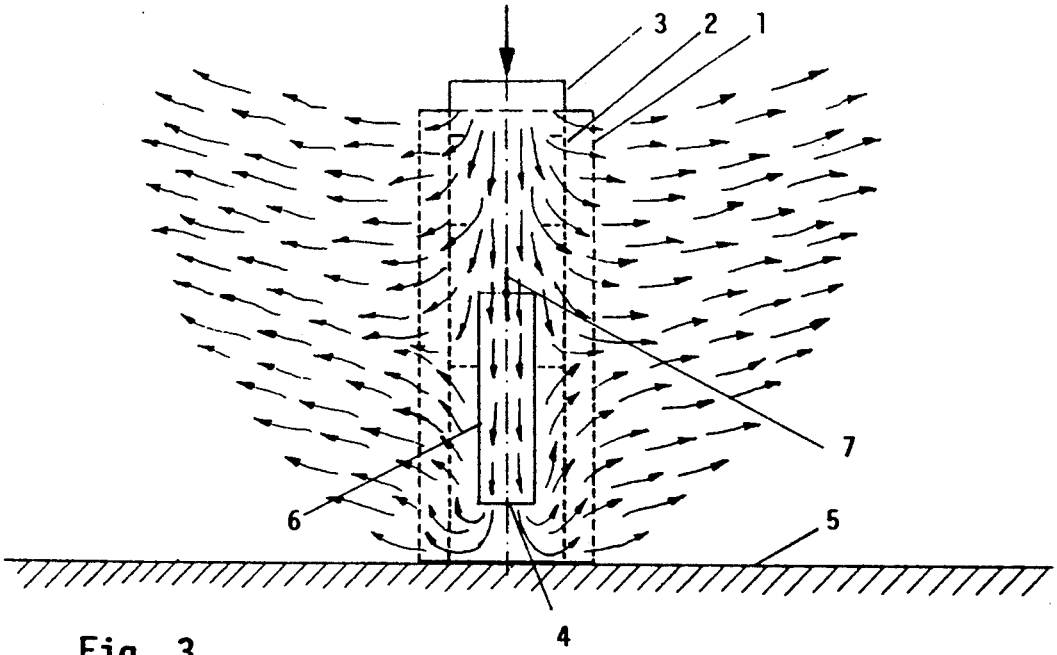
Figure 4:
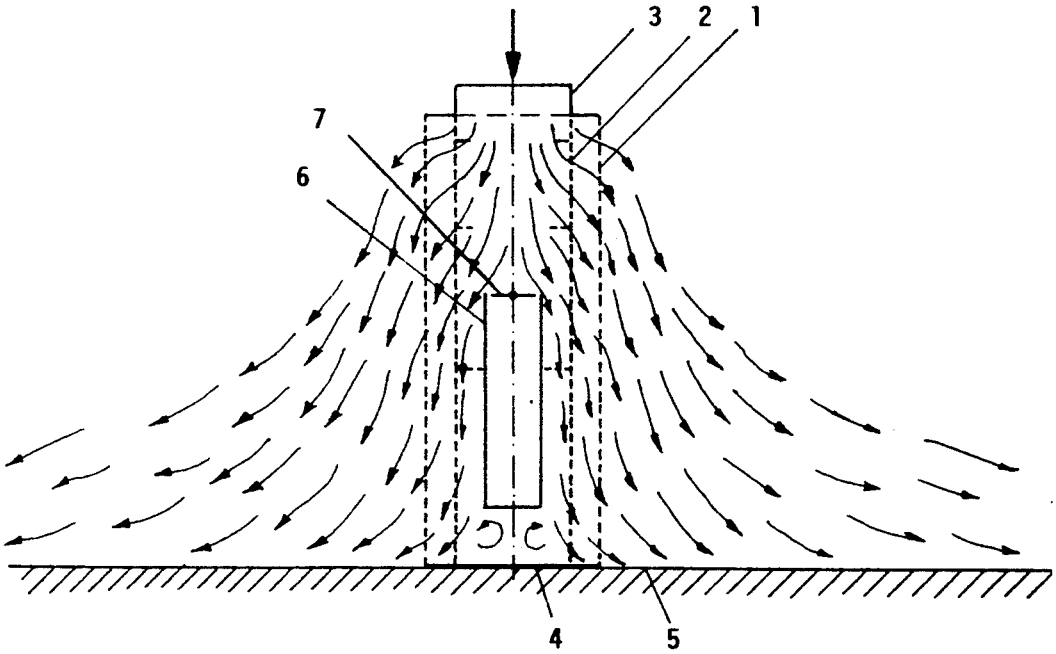

The incoming air arrives inside inner cylinder 2 through air intake 3 and emerges through 1 into the space being treated. Pipe 6 can be obstructed and unobstructed to vary the pattern of air flow as illustrated in FIGS. 3 and 4.

If the incoming air is cooler than the ambient air, valve 7 opens. Some of the incoming air will flow vertically through pipe 6 and some will emerge radially through outer cylinder 1 as illustrated in FIG. 3. The air flowing through pipe 6 is deflected at the base 4 of the air distributor into lower compartment 14. From compartment 14 it emerges from the bottom of outer cylinder 1. All of the incoming air leaving the distributor will accordingly flow slightly upward as illustrated in FIG. 3. Since the incoming air is cooler than the ambient air it will enter the occupied space due to its higher density alone.

Incoming air with a high subtemperature in relation to the ambient air can sometimes be uncomfortable. A reasonable way of counteracting this situation is to induce the incoming air to adopt a variable swirling motion. The temperature of the swirling air will adjust to that of the ambient air more rapidly. The swirl is produced by the fan 9 in pipe 6. When fan 9 threatens to unacceptably weaken the thrust of the warmer incoming air as now to be specified, however, valve 7 will close, eliminating the swirl.

When the space is being heated and the incoming air is warmer than the ambient air, valve 7 closes and no air can flow through pipe 6. The result is a current that flows steeply down along the outside of the distributor as illustrated in FIG. 4 and more and more rapidly as it approaches the floor, In this state the distributor counteracts the tendency of the warm incoming air to rise rapidly, The resulting acceleration in the flow of ambient air is acceptable because heating usually occurs before the commencement of work, In summer, when the incoming air is warmer than the ambient air, the distributor is operated in the state illustrated in FIG. 4, More rapid flow in fact is desirable rather than detrimental when the ambient air is warmer.

We claim:

1. An upwelling-air distributor for air-conditioning systems comprising: two concentric air-permeable cylinders, one of said cylinders being an outer cylinder and the other one of said cylinders being an inner cylinder; at least one diaphragm in form of flat rings inside said inner cylinder; an air intake at one end of said distributor for connecting said distributor to a ventilating system; a pipe inside said inner cylinder; a butterfly valve inside said pipe, said pipe being open at an end remote from said air intake, so that air can flow through said pipe when said valve is not closed.

2. An upwelling-air distributor as defined in claim 1, including a swirl-inducing fan inside said pipe.

3. An upwelling-air distributor as defined in claim 2, wherein said fan can be raised and lowered, said fan having blades with an adjustable angle.

4. An upwelling-air distributor as defined in claim 1, wherein said valve is an electrically operated valve.

5. An upwelling-air distributor as defined in claim 1, wherein said valve is a pneumatically-operated valve.

6. An upwelling-air distributor as defined in claim 1, including another diaphragm in form of a flat horizontal ring in a gap between said pipe and said inner cylinder and dividing said gap vertically into two compartments.

7. An upwelling-air distributor as defined in claim 1, wherein said at least one diaphragm has solid peripheries.

8. An upwelling-air distributor as defined in claim 1, wherein said at least one diaphragm has perforated peripheries.

* * * * *